US009640933B2

(12) United States Patent
Kawamura et al.

(10) Patent No.: US 9,640,933 B2
(45) Date of Patent: May 2, 2017

(54) WIRE WITH TERMINAL AND METHOD OF MANUFACTURING WIRE WITH TERMINAL

(71) Applicant: SUMITOMO WIRING SYSTEMS, LTD., Mie (JP)

(72) Inventors: Masayuki Kawamura, Mie (JP); Toshiyuki Ihara, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 14/650,019

(22) PCT Filed: Jul. 22, 2013

(86) PCT No.: PCT/JP2013/069761
§ 371 (c)(1),
(2) Date: Jun. 5, 2015

(87) PCT Pub. No.: WO2014/097672
PCT Pub. Date: Jun. 26, 2014

(65) Prior Publication Data

US 2015/0318654 A1 Nov. 5, 2015

(30) Foreign Application Priority Data

Dec. 19, 2012 (JP) ..... 2012-276580

(51) Int. Cl.
*H01R 4/10* (2006.01)
*H01R 43/048* (2006.01)
(Continued)

(52) U.S. Cl.
CPC ..... *H01R 43/048* (2013.01); *H01R 4/183* (2013.01); *H01R 4/185* (2013.01); *H01R 4/70* (2013.01); *H01R 4/62* (2013.01); *Y10T 29/49187* (2015.01)

(58) Field of Classification Search
CPC ..... H01R 43/048
(Continued)

(56) References Cited

U.S. PATENT DOCUMENTS 4,310,719 A * 1/1982 Cross ..... H01R 4/029 174/94 R
4,679,874 A 7/1987 Saijo et al.
(Continued)

FOREIGN PATENT DOCUMENTS

JP 51-7512 2/1976
JP 59-117073 8/1984
(Continued)

OTHER PUBLICATIONS

Search report from PCT/JP2013/069761, mail date is Oct. 8, 2013.
International Preliminary Report of Patentability Mar. 16, 2015.

*Primary Examiner* — Tulsidas C Patel
*Assistant Examiner* — Peter G Leigh
(74) *Attorney, Agent, or Firm* — Greenblum & Bernstein, P.L.C.

(57) ABSTRACT

A method of manufacturing a wire with terminal includes: a) crimping a core wire crimping portion of a terminal onto an exposed core wire extending from an insulating sheathing member at an end portion of a wire; b) crimping a sheath crimping portion of the terminal onto the insulating sheathing member; and c) designating at least one of a first trough-shaped combination portion, which links a terminal connection portion of the terminal and the core wire crimping portion, and a second trough-shaped combination portion, which links the core wire crimping portion and the sheath crimping portion, as a target combination portion and deforming the upright tabs of the target combination portion into an arc shape bulging outward.

6 Claims, 8 Drawing Sheets

(51) Int. Cl.
*H01R 4/18* (2006.01)
*H01R 4/70* (2006.01)
*H01R 4/62* (2006.01)

(58) Field of Classification Search
USPC ..... 439/877
See application file for complete search history.

(56) References Cited

U.S. PATENT DOCUMENTS 5,736,678 A * 4/1998 Kobayashi ..... H01R 13/115 174/176
5,971,816 A * 10/1999 Chaillot ..... H01R 13/113 439/852
6,102,752 A * 8/2000 Bommel ..... H01R 13/18 439/845
6,513,235 B1 * 2/2003 Ohsumi ..... H01R 4/185 29/747
6,782,608 B2 * 8/2004 Ohsumi ..... H01R 4/185 29/747
7,306,495 B2 * 12/2007 Hashimoto ..... H01R 4/185 439/877
7,775,842 B2 * 8/2010 Yamagami ..... H01R 4/185 439/877
7,828,612 B2 * 11/2010 Kumakura ..... H01R 4/185 439/877
7,905,745 B2 * 3/2011 Watanabe ..... H01R 4/62 439/442
8,177,590 B2 * 5/2012 Tanaka ..... H01R 4/185 439/877
8,328,589 B2 * 12/2012 Hasebe ..... H01R 4/184 439/877
9,048,606 B2 * 6/2015 Shinmi ..... H01R 43/048
9,065,190 B2 * 6/2015 Kuwayama ..... H01R 4/188
9,083,100 B2 * 7/2015 Uno ..... H01R 4/70
9,153,879 B2 * 10/2015 Frimmersdorf ..... H01R 4/28
2005/0026515 A1 * 2/2005 Hashimoto ..... H01R 4/185 439/877
2005/0287875 A1 * 12/2005 Kojima ..... H01R 4/185 439/750
2007/0197089 A1 * 8/2007 Tabata ..... H01R 4/185 439/587
2010/0035482 A1 * 2/2010 Nakamura ..... H01R 4/185 439/775
2010/0230160 A1 * 9/2010 Ono ..... H01R 4/185 174/84 C
2011/0136397 A1 * 6/2011 Koga ..... H01R 4/185 439/877
2011/0177728 A1 * 7/2011 Uchiyama ..... H01R 43/048 439/877
2013/0252481 A1 * 9/2013 Sato ..... H01R 4/70 439/736
2014/0311799 A1 * 10/2014 Kawamura ..... H01R 43/048 174/75 R
2014/0349501 A1 * 11/2014 Aizawa ..... H01R 4/72 439/190

FOREIGN PATENT DOCUMENTS

JP 1-164670 11/1989
JP 6-36215 5/1994
JP 2005-50736 2/2005
JP 2009-245807 10/2009
JP 2010-232119 10/2010

* cited by examiner

WIRE WITH TERMINAL AND METHOD OF MANUFACTURING WIRE WITH TERMINAL

FIELD OF THE INVENTION

The present invention relates to technology to crimp a terminal onto an end portion of a wire.

BACKGROUND OF THE INVENTION

A metal fitting such as a terminal may be attached to an end portion of a wire in a wire harness or the like. The terminal has a configuration (referred to as a "crimped terminal") linking, for example, a terminal connection portion (referred to as a contact) connected to an end portion of a mating terminal by engaging with the mating terminal; a core wire crimping portion (referred to as a wire barrel) crimped and connected to a core wire exposed from an insulating sheath on the end portion of the wire; and a sheath crimping portion (referred to as an insulation barrel) crimped onto the insulating sheath on the end portion of the wire.

Such a terminal is fixated to the end portion of the wire by bending and crimping a portion of the sheath crimping portion to the insulating sheath, and by bending and crimping a portion of the core wire crimping portion to the core wire (see, e.g., Patent Literature 1). The wire having the terminal attached to the end portion thereof is also referred to in the following as a "wire with terminal."

RELATED ART

Patent Literature

Patent Literature 1: Japanese Patent Laid-open Publication No. 2010-232119

SUMMARY OF THE INVENTION

Problems to be Solved by the Invention

In this regard, the terminal is for example a member in which tin plating is applied to a metallic material principally composed of copper, such as copper, a copper alloy, or the like. Herein, in a case where the core wire of the wire is an aluminum wire, for example, when rainwater, water condensation, or the like adheres to the aluminum wire touching the terminal principally composed of copper in a state where an impurity such as a salt is adhered thereto, corrosion may occur due to galvanic corrosion.

In order to prevent such corrosion, an anti-corrosion sheath is formed, for example, on a portion where dissimilar metals make contact with each other (for example, a portion where the core wire and the terminal touch), and advancement of liquid to this portion is prevented effectively.

An anti-corrosive sheath can be formed by, for example, dripping a molten material, in which an anti-corrosion material (such as a resin) has been melted by heat, onto a portion to be coated and then cooling and solidifying the material. At this point, if the molten material does not uniformly spread over the entire portion to be covered, localized thinness in a coating thickness of the sheath on the portion to be covered may occur, through which corrosion may develop.

For example, as noted above, the core wire crimping portion and the sheath crimping portion have a portion that is bent and crimped to the wire, therefore providing overall a gently curving, substantially circular shape in cross-section with no sharp corners. In a portion having such a shape, the dripped molten material flows comparatively smoothly along a periphery of the wire with terminal. Therefore, a sheath having a uniform and sufficient coating thickness is readily formed around a circumference direction of the wire with terminal.

In this regard, a combination portion between the terminal connection portion and the core wire crimping portion (referred to as a first transition) or a combination portion between the core wire crimping portion and the sheath crimping portion (referred to as a second transition) is not crimped to the wire in the way the core wire crimping portion and the sheath crimping portion are. Therefore, even after the terminal is attached to the wire, the combination portions have a trough shape (i.e., substantially a "U" shape in cross-section) in which side walls stand up substantially orthogonally from both edges of a bottom portion. In the portion having such a shape, the flow of the dripped molten material is likely to be obstructed by circumference direction end portions (specifically, forefront ends of the side walls) of the combination portion and the molten material is unlikely to make its way past the corner of the end portions and around the portion. In addition, the molten material dripped onto a lateral surface portion (specifically, an outer surface of the side walls) of the combination portion is likely to drip downward and unlikely to collect in the lateral surface portion. Therefore, localized thinness in a coating thickness of the anti-corrosive sheath may occur at the corner of the end portions and at the lateral surface portion of the combination portion.

The present invention has been conceived in light of the circumstances above and provides a technology capable of inhibiting localized thinness in a coating thickness of a sheath formed on a wire with terminal.

Means for Solving the Problems

A first aspect is a method of manufacturing a wire with terminal comprising a wire and a terminal attached to an end portion of the wire, the method comprising: a) a step of crimping a core wire crimping portion of the terminal onto an exposed core wire extending from an insulating sheathing member at the end portion of the wire; b) a step of crimping a sheath crimping portion of the terminal onto the insulating sheathing member; and c) a step of designating at least one of a first combination portion, which links a terminal connection portion of the terminal and the core wire crimping portion and comprises a bottom and upright tabs standing upright from each of two ends of the bottom, and a second combination portion, which links the core wire crimping portion and the sheath crimping portion and comprises a bottom and upright tabs standing upright from each of two ends of the bottom, as a target combination portion and deforming the upright tabs of the target combination portion into an arc shape bulging outward.

A second aspect is the method of manufacturing the wire with terminal according to the first aspect, in which the core wire crimping portion and the first combination portion are pinched between a first top mold and a bottom mold to crimp the core wire crimping portion onto the exposed core wire and to deform the upright tabs of the first combination portion into an arc shape bulging outward.

A third aspect is the method of manufacturing the wire with terminal according to the first or second aspect, in which the sheath crimping portion is pinched between a second top mold and a bottom mold to crimp the sheath crimping portion onto the insulating sheathing member, and the second combination portion is pinched between the bottom mold and a third top mold distinct from the second top mold to deform the upright tabs of the second combination portion into an arc shape bulging outward.

A fourth aspect is a wire with terminal comprising: a wire; a terminal attached to an end portion of the wire; a first crimped portion where a core wire crimping portion of the terminal is crimped onto an exposed core wire extending from an insulating sheathing member at the end portion of the wire; a second crimped portion where a sheath crimping portion of the terminal is crimped onto the insulating sheathing member; and a deformed portion where at least one of a first combination portion, which links a terminal connection portion of the terminal and the core wire crimping portion and comprises a bottom and upright tabs standing upright from each of two ends of the bottom, and a second combination portion, which links the core wire crimping portion and the sheath crimping portion and comprises a bottom and upright tabs standing upright from each of two ends of the bottom, is designated as a target combination portion and the upright tabs of the target combination portion are deformed into an arc shape bulging outward.

Effect of the Invention

According to the first and fourth aspects, at least one of the first combination portion and the second combination portion of the terminal is designated as the target combination portion and the upright tabs thereof are deformed into an arc shape bulging outward. With this configuration, flow of a coating material is unlikely to be obstructed by end portions of the upright tabs, and the coating material is unlikely to drip off. Therefore, localized thinness in the coating thickness of the sheath formed on the wire with terminal can be inhibited.

According to the second aspect, the first combination portion is deformed by a mold shared with the core wire crimping portion. Therefore, the first combination portion can be deformed without adding complexity to a mold configuration.

According to the third aspect, the second combination portion is deformed by a mold that is distinct from the mold deforming the sheath crimping portion. Therefore, the second combination portion can be deformed into an appropriate shape.

The purpose, features, aspects and advantages of the present invention will be made clearer by the following detailed description and the accompanying drawings.

MODE FOR CARRYING OUT THE INVENTION

Figure 1:
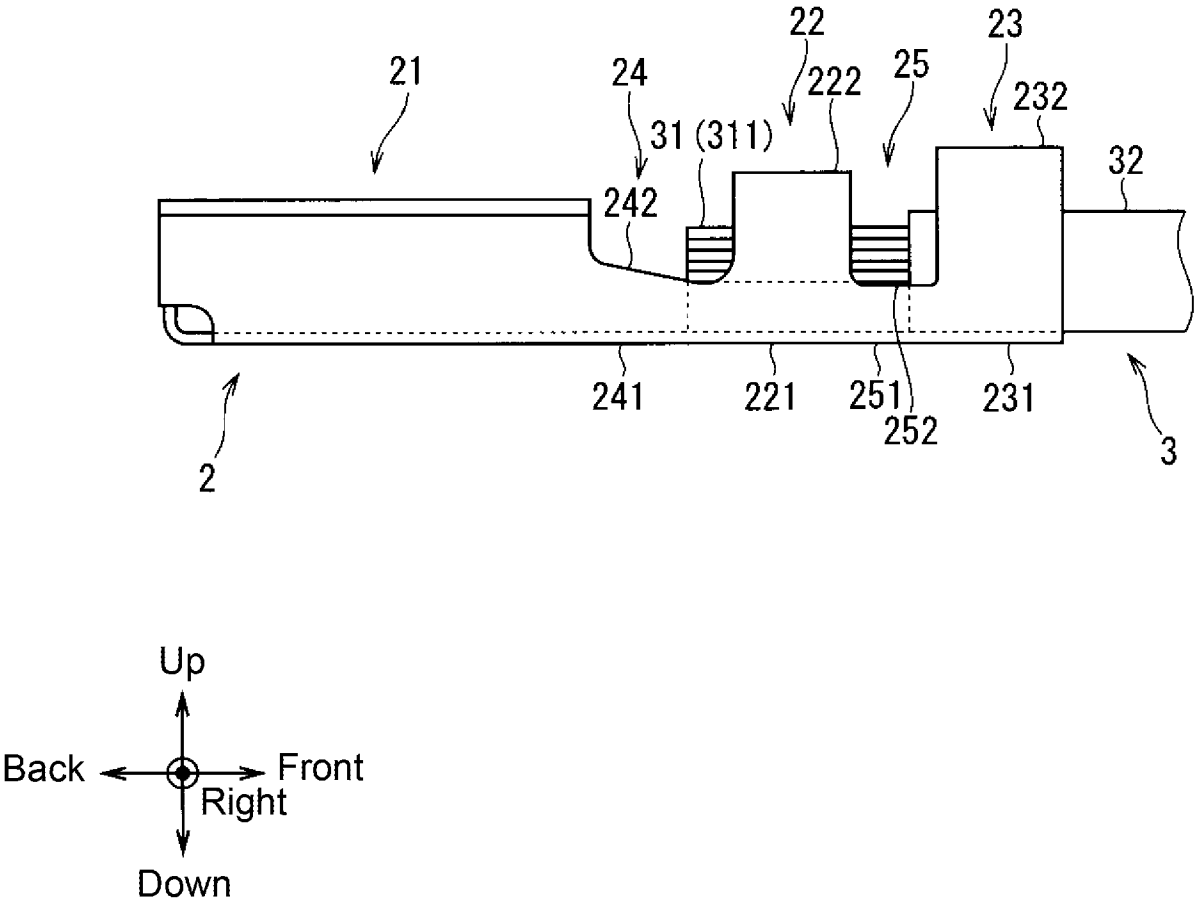
FIG. 1 is a schematic side view of a terminal and a wire prior to crimping.

Hereafter, an embodiment is described with reference to the drawings. The following embodiment is a concrete example of the present invention and does not limit the technical scope of the present invention. Moreover, in the drawings, dimensions and numbers of various portions may be represented in an exaggerated or simplified form in order to facilitate understanding.

<1. Terminal 2 and Wire 3>

Figure 2:
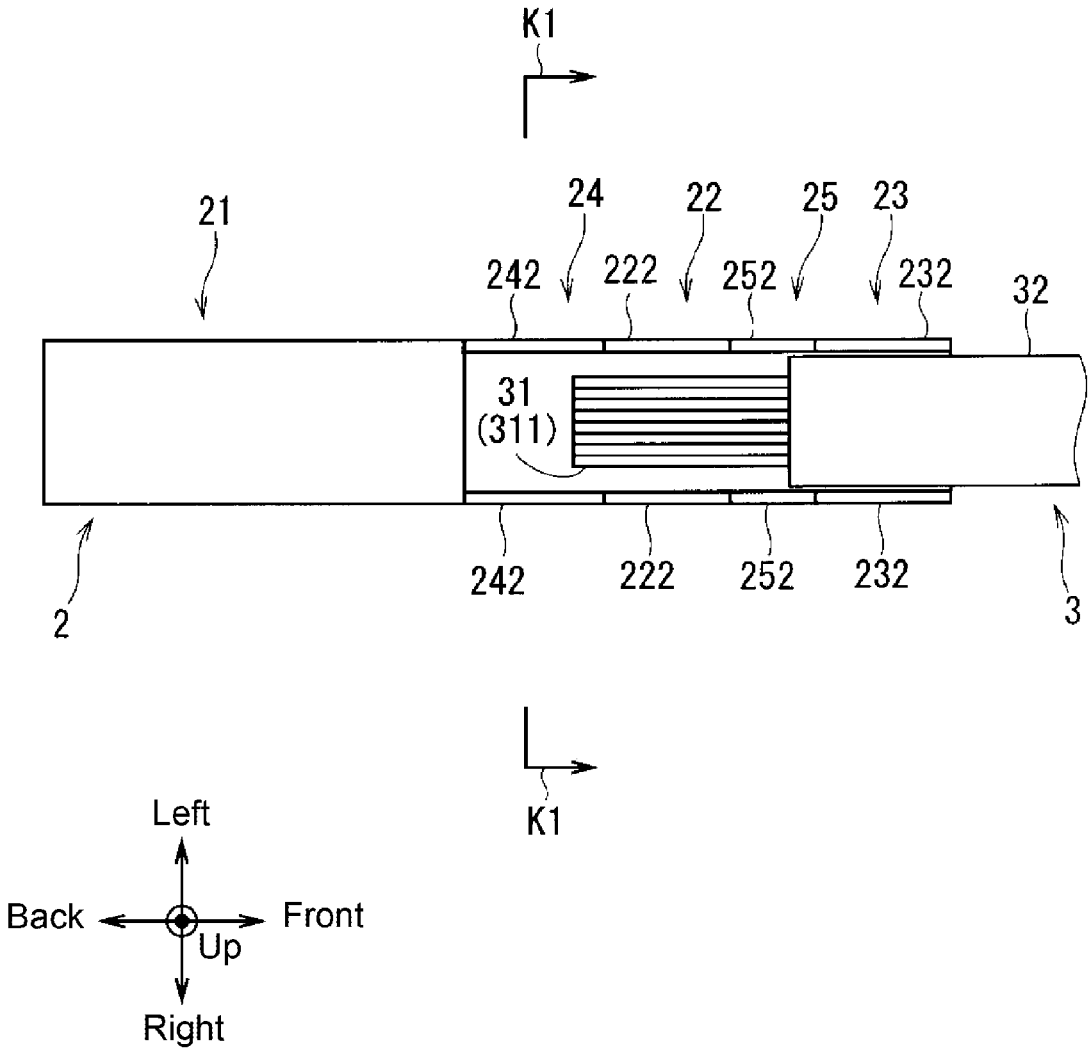
FIG. 2 is a schematic top view of the terminal and the wire prior to crimping.
Figure 3:
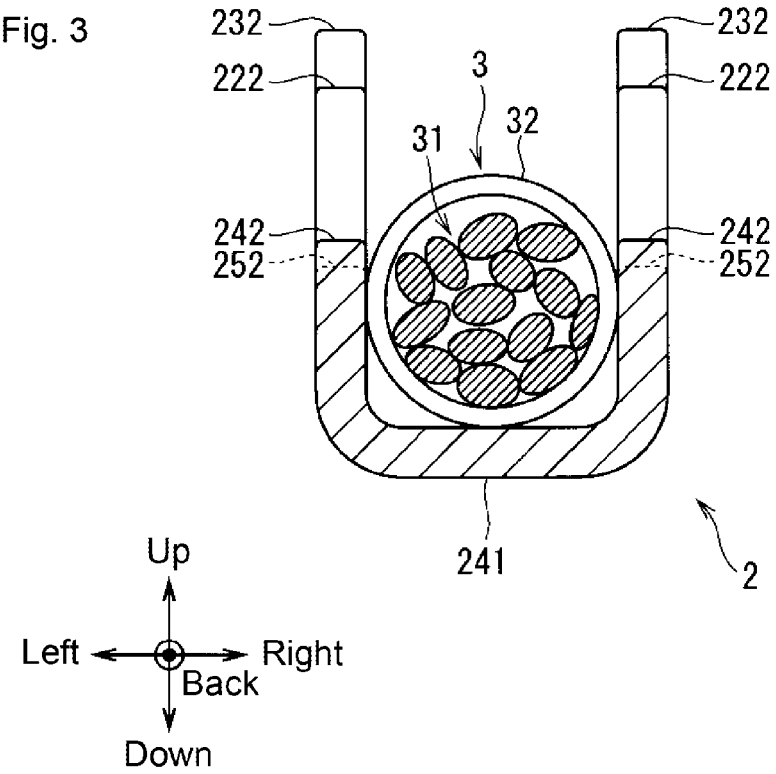
FIG. 3 is a schematic cross-sectional view of the terminal and the wire prior to crimping.

A wire with terminal 1 is formed by crimping a terminal 2 onto an end portion of a wire 3. Before describing the wire with terminal 1, the terminal 2 and the wire 3 prior to crimping are described with reference to FIGS. 1 to 3. FIG. 1 is a schematic side view of the terminal 2 and the wire 3 prior to crimping. FIG. 2 is a schematic top view of the terminal 2 and the wire 3 prior to crimping. FIG. 3 is a schematic cross-sectional view of the terminal 2 and the wire 3 as viewed along an arrow K1 in FIG. 2.

<Wire 3>

The wire 3 includes a core wire 31 and an insulating sheathing member 32 that covers an outer circumference of the core wire 31. The core wire 31 is configured by a strand wire or solid wire of a metal such as aluminum, aluminum alloy, copper, or copper alloy, for example. The insulating sheathing member 32 is formed by extrusion coating, for example. At an end portion of the wire 3, the insulating sheathing member 32 is stripped off and the core wire 31 is exposed. Hereafter, the core wire 31 exposed at the end of the wire 3 is also referred to as "an exposed core wire 311."

<Terminal 2>

The terminal 2 is, for example, a copper alloy member containing copper or brass, for example, or a conductor member in which tin (Sn) plating or a tin alloy plating is applied to such copper alloy members, the tin alloy plating having silver (Ag), copper (Cu), bismuth (Bi), or the like added to tin.

The terminal 2 includes a terminal connection portion 21, a core wire crimping portion 22, and a sheath crimping portion 23. The terminal 2 further includes a combination portion (first combination portion) 24 linking the terminal connection portion 21 and the core wire crimping portion 22, and a combination portion (second combination portion) 25 linking the core wire crimping portion 22 and the sheath crimping portion 23. In the following, a direction along a length direction of the terminal 2 is designated as a "front-back direction," a side where the terminal connection portion 21 is provided is designated as a "rear side," and a side where the sheath crimping portion 23 is provided is designated as a "front side." In addition, when the terminal 2 has a trough shape overall (i.e., substantially a "U" shape in cross-section), a bottom side of a channel is designated as a "lower side" and an opening side of the channel is designated as an "upper side." Moreover, a direction orthogonal to the front-back direction and the up-down direction is designated as a "left-right direction."

The terminal connection portion 21 is a portion connected to a mating terminal. Herein, the terminal connection portion 21 is formed in substantially a tubular shape (referred to as a female terminal shape), into which a mating terminal having a pin- or tab-shaped connection portion (referred to as a male terminal) can be inserted and connected. The terminal connection portion 21 may also be formed in a pin or tab shape (referred to as a male terminal shape), or may be formed in an annular shape capable of connecting to the mating member with threading, or the like.

The core wire crimping portion 22 is a portion crimped onto the exposed core wire 311 of the wire 3, and includes a bottom 221 and a pair of core wire crimp tabs 222. The pair of core wire crimp tabs 222 are elongated tab-shaped portions formed standing upright, substantially orthogonally to the upper side, from each of two left-right direction ends of the flat plate-shaped bottom 221. The core wire crimping portion 22 is formed in a trough shape overall.

The sheath crimping portion 23 is a portion crimped onto the insulating sheathing member 32 of the wire 3, and includes a bottom 231 and a pair of sheath crimp tabs 232. The pair of sheath crimp tabs 232 are elongated tab-shaped portions formed standing upright, substantially orthogonally to the upper side, from each of two left-right direction ends of the flat plate-shaped bottom 231. The sheath crimping portion 23 is formed in a trough shape overall.

The first combination portion 24 is a portion linking the terminal connection portion 21 and the core wire crimping portion 22, and includes a bottom 241 and a pair of upright tabs 242. The pair of upright tabs 242 are elongated tab-shaped portions formed standing upright, substantially orthogonally to the upper side, from each of two left-right direction ends of the flat plate-shaped bottom 241. The first combination portion 24 is formed in a trough shape overall. The bottom 241 is linked, at a rear end thereof, to a front end of the bottom of the terminal connection portion 21 and is linked, at a front end thereof, to a rear end of the bottom 221 of the core wire crimping portion 22. Each of the upright tabs 242 is linked, at a rear end thereof, to a front end of a side wall of the terminal connection portion 21 and is linked, at a front end thereof, to a rear end of the core wire crimp tabs 222 of the core wire crimping portion 22.

The second combination portion 25 is a portion linking the core wire crimping portion 22 and the sheath crimping portion 23, and includes a bottom 251 and a pair of upright tabs 252. The pair of upright tabs 252 are elongated tab-shaped portions formed standing upright, substantially orthogonally to the upper side, from each of two left-right direction ends of the flat plate-shaped bottom 251. The second combination portion 25 is formed in a trough shape overall. The bottom 251 is linked, at a rear end thereof, to a front end of the bottom 221 of the core wire crimping portion 22 and is linked, at a front end thereof, to a rear end of the bottom 231 of the sheath crimping portion 23. In addition, each of the upright tabs 252 is linked, at a rear end thereof, to a front end of the core wire crimp tabs 222 of the core wire crimping portion 22 and is linked, at a front end thereof, to a rear end of the sheath crimp tabs 232 of the sheath crimping portion 23.

<2. Wire with Terminal 1>

Figure 4:
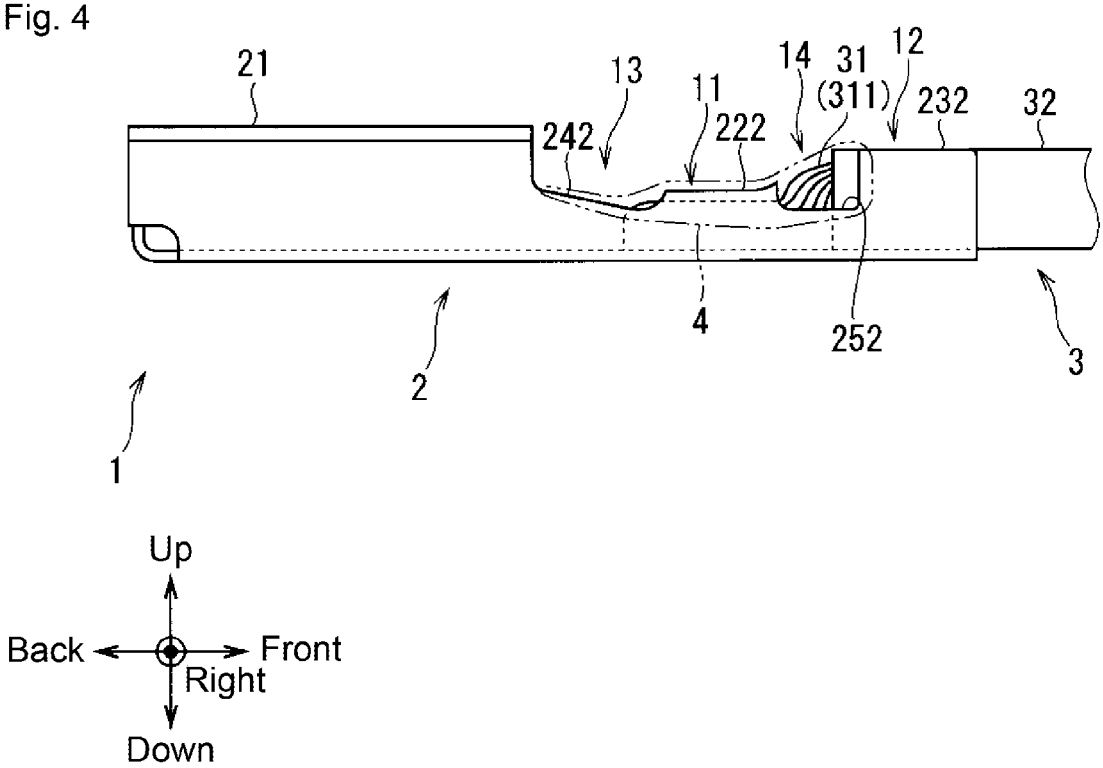
FIG. 4 is a schematic side view of a wire with terminal.
Figure 5:
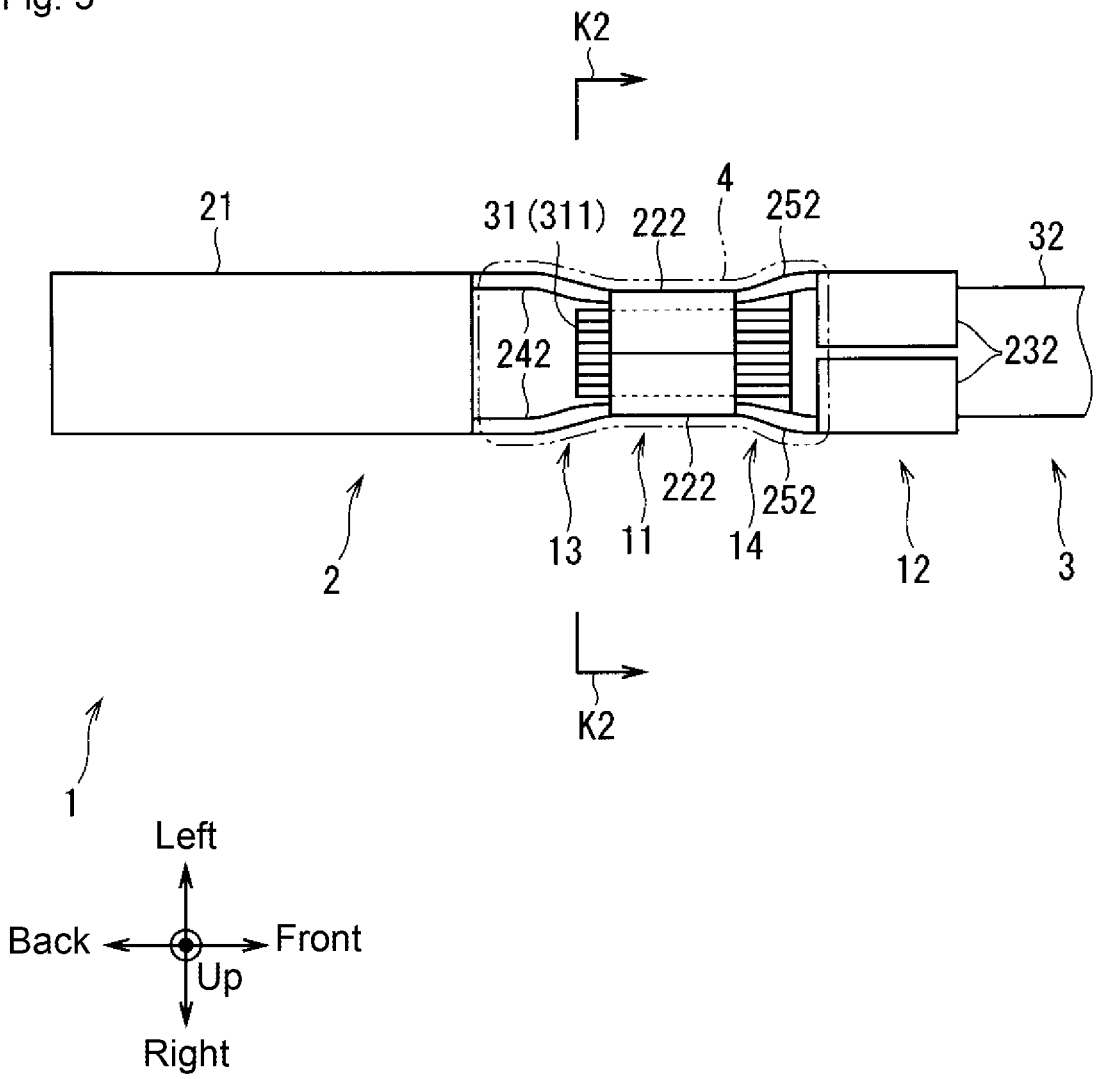
FIG. 5 is a schematic top view of the wire with terminal.
Figure 6:
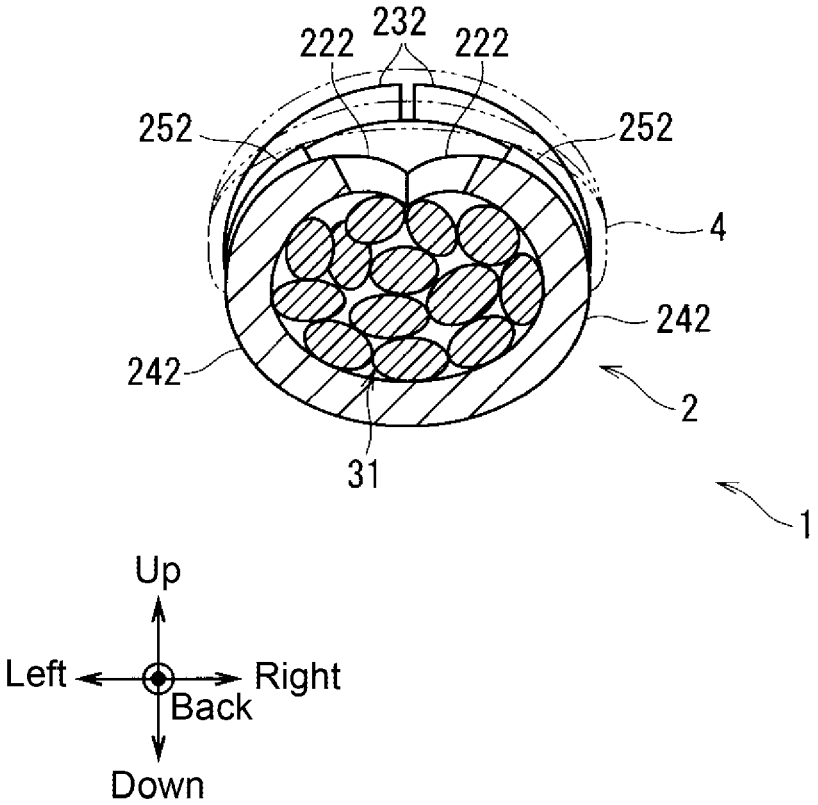
FIG. 6 is a schematic cross-sectional view of the wire with terminal.

The wire with terminal 1 is described with reference to FIGS. 4 to 6. FIG. 4 is a schematic side view of the wire with terminal 1. FIG. 5 is a schematic top view of the wire with terminal 1. FIG. 6 is a schematic cross-sectional view of the wire with terminal 1 as viewed along an arrow K2 in FIG. 5.

The wire with terminal 1 is formed by crimping the terminal 2 onto the end portion of the wire 3. Specifically, in the wire with terminal 1, the pair of core wire crimp tabs 222 of the core wire crimping portion 22 include a portion (first crimped portion) 11, which is in a state crimped onto the exposed core wire 311 by compression-deformation so as to envelop the exposed core wire 311 of the wire 3. In addition, in the wire with terminal 1, the pair of sheath crimp tabs 232 of the sheath crimping portion 23 include a portion (second crimped portion) 12, which is in a state crimped onto the insulating sheathing member 32 by compression-deformation so as to envelop the end portion of the insulating sheathing member 32 of the wire 3. In this way, by crimping the core wire crimping portion 22 and the sheath crimping portion 23 onto the wire 3, the end portion of the wire 3 and the terminal 2 are connected. The first crimped portion 11, in which the core wire crimping portion 22 is crimped onto the wire 3, primarily fills a role of electrically connecting the terminal 2 and the core wire 31 of the wire 3. The second crimped portion 12, in which the sheath crimping portion 23 is crimped onto the wire 3, primarily fills a role of firmly holding the wire 3 and fixating the wire 3 with respect to the terminal 2.

The wire with terminal 1 further includes a portion where the wire 3 (specifically, a forefront end portion of the exposed core wire 311 protruding from the compression-deformed core wire crimping portion 22) is accommodated in a trench-shaped portion formed by the pair of upright tabs 242 and the bottom 241 of the first combination portion 24. Herein, a portion on at least a front side of the first combination portion 24 (specifically, a portion on the pair of upright tabs 242 on at least the exposed core wire 311 side) is in a state where a circumference direction end portion (specifically, each top end portion of the pair of upright tabs 242) is deformed inward. A state where the circumference direction end portion is deformed inward specifically refers to a state where, for example, at least a top end portion of each upright tab 242 is deformed into a shape gently curving (preferably, curved in an arc shape) in a direction approaching the other upright tab 242 toward the top end. Hereafter, the portion deformed in this way is referred to as a "first deformed portion 13."

The wire with terminal 1 further includes a portion where the wire 3 (specifically, a portion proximate to a boundary position between the exposed core wire 311 and the insulating sheathing member 32 of the wire 3, for example) is accommodated in a trench-shaped portion formed by the pair of upright tabs 252 and the bottom 251 of the second combination portion 25. Herein, the second combination portion 25 is in a state where a circumference direction end portion (specifically, each top end portion of the pair of upright tabs 252) is deformed inward. A state where the circumference direction end portion is deformed inward specifically refers to a state where, for example, at least a top end portion of each upright tab 252 is deformed into a shape gently curving (preferably, curved in an arc shape) in a direction approaching the other upright tab 252 toward the top end. Hereafter, the portion deformed in this way is referred to as a "second deformed portion 14."

The wire with terminal 1 further includes a corrosion-proofing sheath 4 to prevent corrosion of the exposed core wire 311. The sheath 4 preferably covers at least a portion where the exposed core wire 311 and the terminal 2 are in contact. Specifically, a rear end of the sheath 4 preferably reaches a position further to the rear than a forefront end of the exposed core wire 311 accommodated in the first combination portion 24. In addition, a front end of the sheath 4 preferably reaches a position further forward than the boundary position between the exposed core wire 311 and the insulating sheathing member 32 accommodated in the second combination portion 25. Further, the sheath 4 preferably covers a region where each of a left and right end of the sheath 4 reaches a position sufficiently further outward (toward the terminal 2) than the boundary position between the terminal 2 and the wire 3 in the circumference direction of the wire with terminal 1.

The sheath 4 inhibits adhesion of liquid or the like to the portion where the exposed core wire 311 and the terminal 2 are in contact by covering the contact portion, thus inhibiting corrosion of the exposed core wire 311. In particular, in a case where aluminum or an aluminum alloy is used as the core wire 31 and a configuration in which a tin plating layer is formed on a copper or copper alloy surface is used as the terminal 2, a potential difference between the core wire 31 and the terminal 2 increases. Therefore, when moisture adheres to the portion where the exposed core wire 311 and the terminal 2 are in contact in a state where an impurity such as a salt is adhered to the contact portion, the moisture may act as an electrolytic solution and lead to electrolytic corrosion. When the sheath 4 covering the contact portion is provided, such electrolytic corrosion can be effectively inhibited.

Herein, as noted above, circumference direction end portions of each of the first deformed portion 13 and the second deformed portion 14 are deformed inward. In addition, each of the first crimped portion 11 and the second crimped portion 12 are deformed so as to envelop the wire 3. Specifically, in the wire with terminal 1, a region to be covered by the sheath 4 has a gently curved, substantially circular shape in cross-section with no sharp corners in the circumference direction thereof. Accordingly, as elucidated hereafter, localized thinness in a coating thickness of the sheath 4 is inhibited, and an anti-corrosive sheath 4 having a uniform and sufficient coating thickness is formed around the circumference direction of the wire with terminal 1. As a result, the portion where the terminal 2 and the wire 3 are in contact is sufficiently protected.

<3. Terminal Crimping Device 5>

Figure 7:
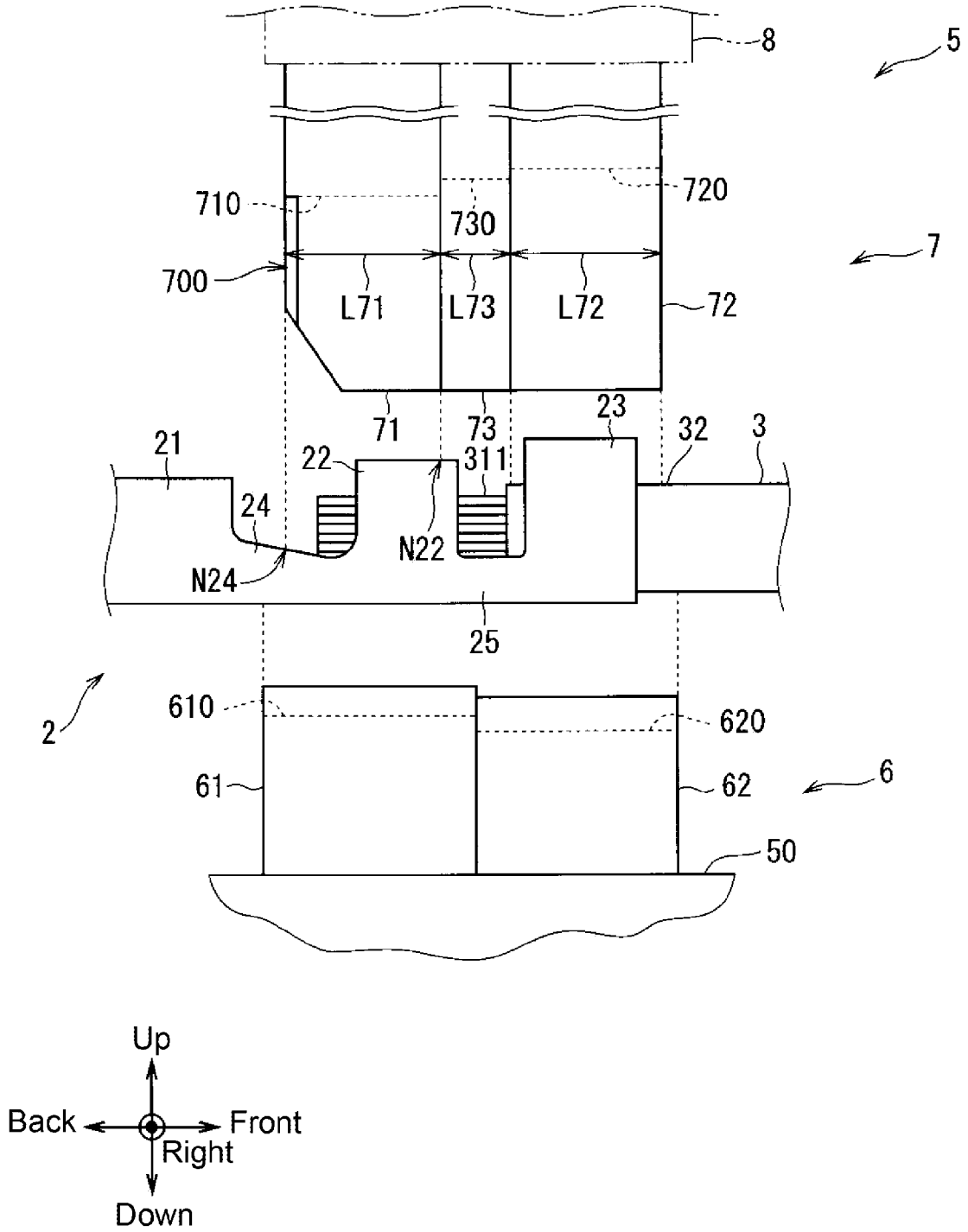
FIG. 7 is a side view schematically illustrating a bottom mold and a top mold.
Figure 8:
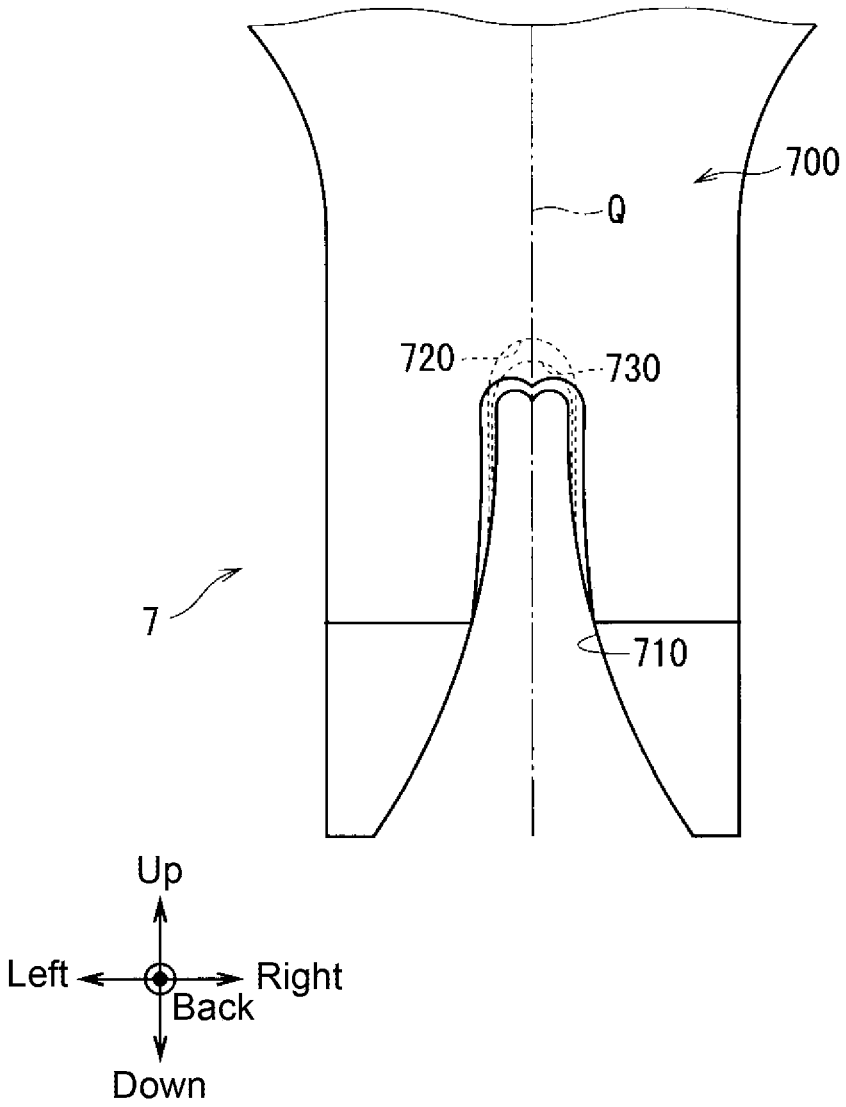
FIG. 8 is a front view schematically illustrating the top mold.

A terminal crimping device 5 used in manufacturing the wire with terminal 1 is described with reference to FIGS. 7 and 8. FIG. 7 is a side view schematically illustrating a bottom mold 6 and a top mold 7 included in the terminal crimping device 5. FIG. 8 is a front view schematically illustrating the top mold 7.

The terminal crimping device 5 includes the bottom mold 6, the top mold 7 arranged facing the bottom mold 6, and a drive portion 8 displacing the top mold 7 so as to approach and withdraw from the bottom mold 6 (i.e., reciprocally displacing the top mold 7 in a direction approaching the bottom mold 6 and a direction drawing away from the bottom mold 6). The drive portion 8 is configured by an actuator such as an air cylinder, a hydraulic cylinder, or the like, for example. In the following, a side on which the top mold 7 is arranged is referred to as the "top side," and a side on which the bottom mold 6 is arranged is referred to as the "bottom side." In addition, when the terminal 2 to be crimped is arranged between the bottom mold 6 and the top mold 7, a side to which the rear side of the terminal 2 is then arranged is referred to as the "rear side" of the terminal crimping device 5 and a side to which the front side of the terminal 2 is arranged is referred to as the "front side." Moreover, a direction orthogonal to the front-back direction and the up-down direction is designated as the "left-right direction."

<i. Bottom Mold 6>

The bottom mold 6 includes a first bottom mold 61 and a second bottom mold 62 arranged forward of the first bottom mold 61.

The first bottom mold 61 is fixated to a platform 50 of the terminal crimping device 5 so as to project upward. A first bottom mold surface (bottom mold surface for core wire) 610 having an arced trench shape in cross-section is formed on a top surface of the first bottom mold 61, enabling the core wire crimping portion 22 and the like of the terminal 2 to be supported by the first bottom mold surface 610. Moreover, a rear end surface of the first bottom mold 61 is arranged further rearward than a rear end surface of the top mold 7 (specifically, a rear end surface 700 of a first top mold 71 described hereafter).

Similarly to the first bottom mold 61, the second bottom mold 62 is fixated to the platform 50 so as to project upward. A second bottom mold surface (bottom mold surface for sheath) 620 having an arced trench shape in cross-section is formed on a top surface of the second bottom mold 62, enabling the sheath crimping portion 23 and the like of the terminal 2 to be supported by the second bottom mold surface 620. Moreover, a front end surface of the second bottom mold 62 is arranged further forward than a front end surface of the top mold 7 (specifically, a front end surface of a second top mold 72 described hereafter).

<ii. Top Mold 7>

The top mold 7 primarily includes the first top mold 71, which is provided to mold the core wire crimping portion 22 and the first combination portion 24; the second top mold 72, which is provided to mold the sheath crimping portion 23; and a third top mold 73, which is provided to mold the second combination portion 25.

<First Top Mold 71>

The first top mold 71 is formed in a long, narrow plate shape, and is provided with a top mold surface (first top mold surface) 710 having a notched trench shape extending from the forefront end thereof toward a base end. An innermost (uppermost) portion of the first top mold surface 710 is, for example, formed in a shape having two laterally aligned arc-shaped circumferential surfaces bulging toward the top, and two side surfaces on a forefront end side of the first top mold surface 710 are formed in a shape gradually expanding toward the forefront end.

The first top mold 71 is arranged so as to face the first bottom mold 61, and the first top mold surface 710 is arranged so as to face the first bottom mold surface 610. Herein, a length L71 of the first top mold 71 along a front-back direction is substantially identical to a length from a position N24 near the rear end of the first combination portion 24 to a position N22 near the front end of the core wire crimping portion 22 of the terminal 2 to be crimped. The "position N24 near the rear end of the first combination portion 24" is a position further forward than the rear end position of the first combination portion 24, and is a position further to the rear than the forefront end of the exposed core wire 311 accommodated in the first combination portion 24. In addition, the "position N22 near the front end of the core wire crimping portion 22" is a position slightly further to the rear than the front end position of the core wire crimping portion 22.

The rear end surface 700 of the first top mold 71 preferably has a shape inclining forward as the rear end surface 700 curves outward from a left-right direction center line Q. With this configuration, when the first top mold 71 is displaced to approach the terminal 2, pressure applied to a surface where the first top mold 71 and the first combination portion 24 make contact is dispersed, and damage to the first combination portion 24 such as cracking is unlikely to occur. In order to inhibit damage to the first combination portion 24, a corner between the rear end surface 700 and the first top mold surface 710 is preferably chamfered, and a vicinity of the forefront end of the rear end surface 700 preferably has a shape inclining forward as the rear end surface 700 advances downward.

<Second Top Mold 72>

The second top mold 72 is formed in a long, narrow plate shape, and is provided with a top mold surface (second top mold surface) 720 having a notched trench shape extending from the forefront end thereof toward a base end. An innermost (uppermost) portion of the second top mold surface 720 is, for example, formed in an arc shape bulging toward the top, and two side surfaces on a forefront end side of the second top mold surface 720 are formed in a shape gradually expanding toward the forefront end. The innermost portion of the second top mold surface 720 is positioned further upward than the innermost portion of the first top mold surface 710.

The second top mold 72 is arranged so as to face the second bottom mold 62, and the second top mold surface 720 is arranged so as to face the second bottom mold surface 620. A length L72 of the second top mold 72 along the front-back direction is substantially identical to, or is slightly longer than, a front-back direction length of the sheath crimping portion 23 of the terminal 2 to be crimped.

<Third Top Mold 73>

A third top mold 73 is formed in a long, narrow plate shape, and is provided with a top mold surface (third top mold surface) 730 having a notched trench shape extending from the forefront end thereof toward a base end. An innermost (uppermost) portion of the third top mold surface 730 is, for example, formed in an arc shape bulging toward the top, and two side surfaces on a forefront end side of the third top mold surface 730 are formed in a shape gradually expanding toward the forefront end. The innermost portion of the third top mold surface 730 is positioned further upward than the innermost portion of the first top mold surface 710, and further downward than the innermost portion of the second top mold surface 720. In addition, a left-right direction width of the third top mold surface 730 is preferably substantially identical to the left-right direction width of the second top mold surface 720. In other words, except for the height of the innermost portion, the third top mold surface 730 can be given substantially the same shape as the second top mold surface 720.

The third top mold 73 is arranged between the first top mold 71 and the second top mold 72. Specifically, the third top mold 73 is arranged so as to face a portion where the first bottom mold 61 and the second bottom mold 62 are coupled together, and the third top mold surface 730 is arranged so as to face a boundary portion between the first bottom mold surface 610 and the second bottom mold surface 620. The rear end surface of the third top mold 73 preferably makes contact with the front end surface of the first top mold 71 in a tightly adhered state, and the front end surface of the third top mold 73 preferably makes contact with the rear end surface of the second top mold 72 in a tightly adhered state. A length L73 of the third top mold 73 along the front-back direction is substantially identical to, or is slightly longer than, a front-back direction length of the second combination portion 25 of the terminal 2 to be crimped.

<4. Manufacturing Method of Wire with Terminal 1>

Figure 9:
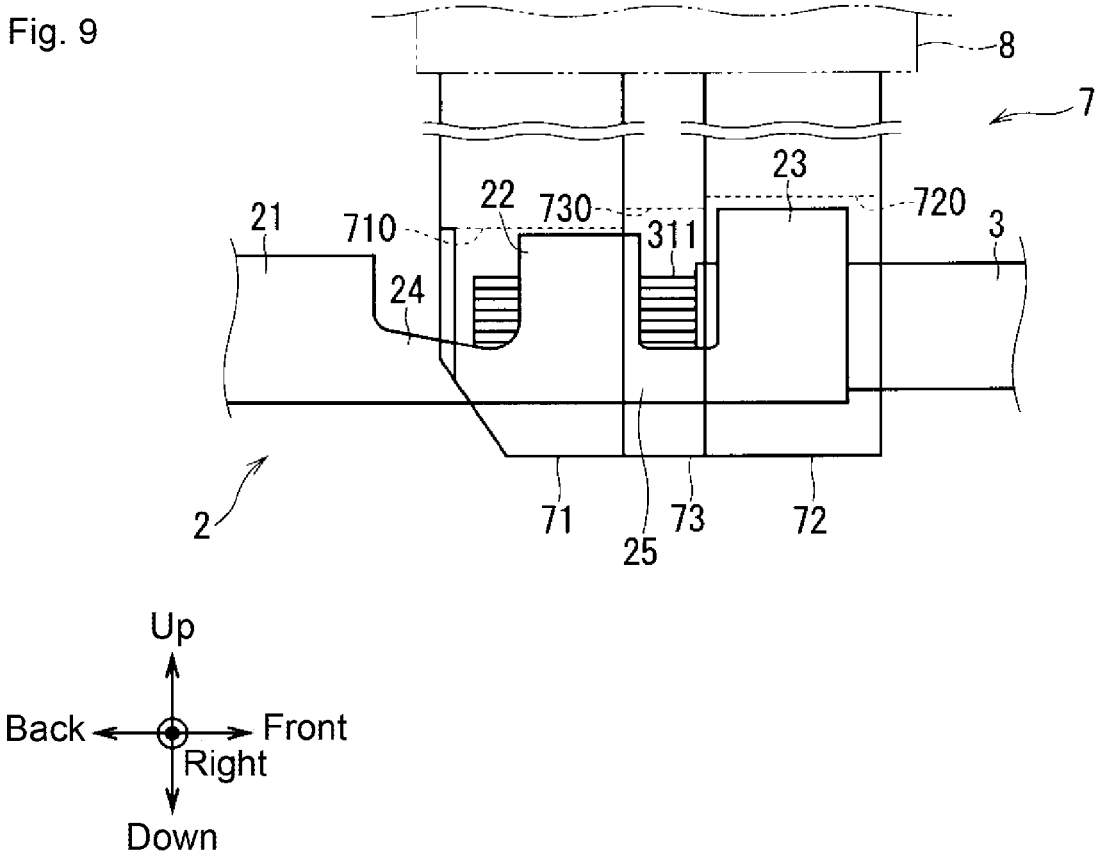
FIG. 9 is an explanatory view of a step in manufacturing the wire with terminal.
Figure 10:
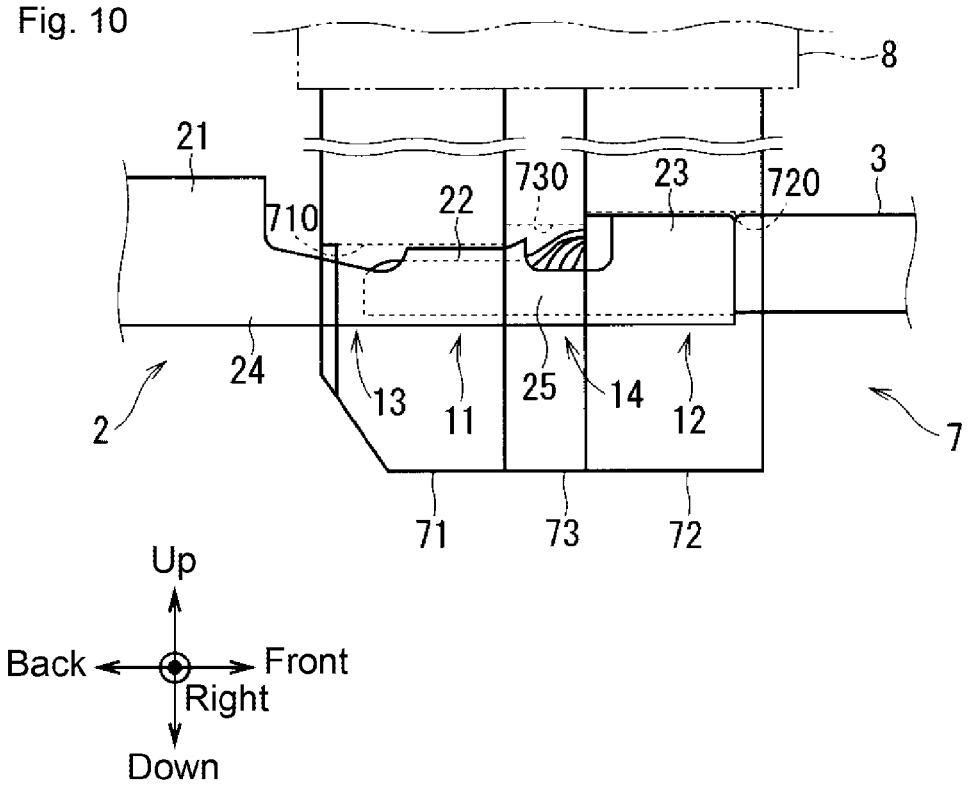
FIG. 10 is an explanatory view of a step in manufacturing the wire with terminal.

A method of manufacturing the wire with terminal 1 using the terminal crimping device 5 is described with reference to FIGS. 7 to 10. FIGS. 9 and 10 are explanatory views of steps in manufacturing the wire with terminal 1. Moreover, in order to facilitate understanding of the drawings, in FIGS. 9 and 10, the top mold 7 is shown in a transparent state and the bottom mold 6 is omitted from the drawings.

<i. First Step>

First, the terminal 2 and the wire 3 are prepared, and these are arranged between the top mold 7 and the bottom mold 6, which are separated from each other (state illustrated in FIG. 7). Specifically, in a state where the top mold 7 is separated from the bottom mold 6, the terminal 2 is in a state of resting on the bottom mold 6, and the wire 3 is in a state arranged inside the terminal 2. At this point, the core wire crimping portion 22 of the terminal 2 is in a state arranged on top of the first bottom mold surface 610, and the sheath crimping portion 23 of the terminal 2 is in a state arranged on top of the second bottom mold surface 620. In addition, the exposed core wire 311 of the wire 3 is in a state arranged within the core wire crimping portion 22, and the end portion of the insulating sheathing member 32 of the wire 3 is in a state arranged within the sheath crimping portion 23.

In a state where the terminal 2 and the wire 3 are arranged at prescribed positions, the rear end surface 700 of the first top mold surface 710 faces the position N24 near the rear end of the first combination portion 24. In addition, a position where the front end surface of the first top mold surface 710 and the rear end surface of the third top mold surface 730 make contact faces the position N22 near the front end of the core wire crimping portion 22. Further, a position where the front end surface of the third top mold surface 730 and the rear end surface of the second top mold surface 720 make contact faces the rear end position of the sheath crimping portion 23 (or a position slightly further to the rear than the rear end position). Also, the front end surface of the second top mold surface 720 faces the front end position of the sheath crimping portion 23 (or a position slightly further forward than the front end position).

<ii. Second Step>

Next, the drive portion 8 displaces the top mold 7 to approach the bottom mold 6 (state shown in FIGS. 9 and 10). Accordingly, the first top mold 71, the second top mold 72, and the third top mold 73 are synchronously displaced to approach the bottom mold 6.

When the first top mold 71 is displaced to approach the bottom mold 6 (specifically, the first bottom mold 61), the first combination portion 24 and the core wire crimping portion 22 are pinched between the first bottom mold surface 610 and the first top mold surface 710. Accordingly, in a portion on at least the front side of the first combination portion 24 (specifically, a portion on the pair of upright tabs 242 on at least the exposed core wire 311 side), a circumference direction end portion of the first combination portion 24 (specifically, forefront end portions of the pair of upright tabs 242) is deformed inward (first deformed portion 13). In addition, the pair of core wire crimp tabs 222 of the core wire crimping portion 22 are crimped onto the exposed core wire 311 by compression-deformation so as to envelop the exposed core wire 311 (first crimped portion 11).

As noted above, the rear end of the first top mold surface 710 faces the position N24 near the rear end further forward than the rear end position of the first combination portion 24. Therefore, a portion of the first combination portion 24 between the rear end position and the position N24 near the rear end projects from the first top mold surface 710. Compression force from the first top mold surface 710 is not applied to this projecting portion, and therefore the projecting portion has a shape in which the upright tabs 242 rise gently as they approach the rear. By ensuring that there is a portion where compression force is not applied to the rear portion of the first combination portion 24, deformation and damage to the terminal connection portion 21 is inhibited.

As noted above, the front end of the first top mold surface 710 faces the position N22 near the front end slightly further to the rear than the front end position of the core wire crimping portion 22. Therefore, a portion of the core wire crimping portion 22 between the front end position and the position N22 near the front end projects from the first top mold surface 710. Compression force from the first top mold surface 710 is not applied to this projecting portion, and therefore the projecting portion has a shape projecting upward and swollen into a tapered shape (a bell mouth shape).

When the second top mold 72 is displaced to approach the bottom mold 6 (specifically, the second bottom mold 62), the sheath crimping portion 23 is pinched between the second bottom mold surface 620 and the second top mold surface 720. Accordingly, the pair of sheath crimp tabs 232 of the sheath crimping portion 23 are crimped onto the end portion of the insulating sheathing member 32 by compression-deformation so as to envelop the end portion of the insulating sheathing member 32 (second crimped portion 12).

When the third top mold 73 is displaced to approach the bottom mold 6 (specifically, the boundary portion between the first bottom mold 61 and the second bottom mold 62), the second combination portion 25 is pinched between the first bottom mold surface 610, the second bottom mold surface 620, and the third top mold surface 730. Accordingly, a circumference direction end portion of the second combination portion 25 (specifically, a forefront end portion of the pair of upright tabs 252) is deformed inward (second deformed portion 14).

<iii. Third Step>

Next, the sheath 4 (see FIGS. 4 to 6) is formed at the portion where the wire 3 (in particular, the exposed core wire 311) and the terminal 2 are in contact. Specifically, the sheath 4 is formed by, for example, dripping a molten material, in which an anti-corrosion material (such as a resin) has been melted by heat, onto the portion to be coated and then cooling and solidifying the material.

Herein, circumference direction end portions of each of the first deformed portion 13 and the second deformed portion 14, which are formed in the second step, are in a state deformed inward. In addition, each of the first crimped portion 11 and the second crimped portion 12, which are also formed in the second step, are deformed so as to envelop the wire 3. Specifically, a portion to be covered has a gently curved, substantially circular shape in cross-section with no sharp corners in the circumference direction thereof. Accordingly, when the molten material is dripped onto the region to be coated, the dripped molten material naturally flows along the circumference direction and thereby fully and uniformly spreads over the circumference direction.

If the circumference direction end portion of the first combination portion 24 of the terminal 2 is not deformed inward and remains standing upright, the flow of the dripped molten material is likely to be blocked by the forefront ends of the upright tabs and is unlikely to make its way past the corner of the forefront ends and around to an outer wall of the upright tabs 242. In addition, the molten material dripped onto the outer wall surface of the upright tabs is likely to drip downward and not collect within the outer wall surface. Therefore, localized thinness in a coating thickness of the anti-corrosive sheath may occur at the corner of the forefront ends and at the outer wall portion of the upright tabs. In contrast, as noted above, in a case where the circumference direction end portion of the first combination portion 24 is deformed inward to form the first deformed portion 13, the flow of the dripped molten material is unlikely to be blocked by the forefront ends of the upright tabs 242 and is able to flow along the outer wall surface of the upright tabs 242. In addition, molten material that flows over the outer wall surface of the upright tabs 242 is also unlikely to drip downward and can be sufficiently collected on the outer wall surface. Accordingly, the molten material fully and uniformly spreads over the circumference direction of the first deformed portion 13. The effect is similar for each of the second deformed portion 14, the first crimped portion 11, and the second crimped portion 12.

When the molten material fully and uniformly spreads over the circumference direction, a result is that a sheath 4 having a uniform and sufficient coating thickness is formed in the region to be coated. By forming such a sheath 4, corrosion at the portion where the terminal 2 and the wire 3 touch can be sufficiently inhibited.

In addition, in the wire with terminal 1, a fracture surface of the terminal 2 (specifically, a top end surface of the upright tabs 242 and 252, a top end surface of the core wire crimp tabs 222, and a top end surface of the sheath crimp tabs 232) is in a state directed inward in the portion to be covered, and the sheath 4 is formed in this state. In this way, a shape is created where the fracture surface is unlikely to be exposed, and corrosion entering through the fracture surface can be particularly adequately avoided by forming the sheath 4.

<5. Effect>

According to the above-described embodiment, in each of the first combination portion 24 and the second combination portion 25 of the terminal 2, the circumference direction end portions are deformed inward. With this configuration, the flow of a coating material is unlikely to be obstructed by the end portions, and the coating material is unlikely to drip off. Therefore, localized thinness in the coating thickness of the sheath 4 formed on the wire with terminal 1 can be inhibited.

In addition, according to the above-described embodiment, the first combination portion 24 is deformed by the first top mold 71, which is shared with the core wire crimping portion 22. Therefore, the first combination portion 24 can be deformed without adding complexity to a mold configuration.

Furthermore, according to the above-described embodiment, the second combination portion 25 is deformed by the third top mold 73, which is distinct from the second top mold 72 which deforms the sheath crimping portion 23. Because the second top mold 72 and the third top mold 73 are distinct members, the third top mold surface 730 and the second top mold surface 720 are readily given different shapes. Specifically, for example, a height of the innermost portion of the third top mold surface 730 is readily positioned lower than the innermost portion of the second top mold surface 720. Accordingly, the circumference direction end portion of the second combination portion 25 can be sufficiently deformed into an expected shape. Specifically, the second combination portion 25 can be deformed into an appropriate shape.

<6. Modifications>

In the above-described embodiment, both the first combination portion 24 and the second combination portion 25 of the terminal 2 were configured such that the circumference direction forefront ends thereof deformed inward on the wire with terminal 1. However, the first combination portion 24 and the second combination portion 25 are not necessarily both required to deform, and a configuration is also possible in which only the first combination portion 24 or only the second combination portion 25 is deformed. For example, in a case where the first combination portion 24 is not deformed, the length of the first top mold 71 along the front-back direction is substantially identical to the length from the rear end of the core wire crimping portion 22 to the position N22 near the front end of the core wire crimping portion 22 of the terminal 2 to be crimped.

In addition, in the above-described embodiment, the height of the innermost portion of the third top mold surface 730 was positioned so as to be higher than the height of the innermost portion of the first top mold surface 710 and lower than the height of the innermost portion of the second top mold surface 720. However, the height of the innermost portion of the third top mold surface 730 is not necessarily limited to this. For example, the height of the innermost portion of the third top mold surface 730 may also be positioned at the same height as the innermost portion of the second top mold surface 720.

In the above, the present invention is described in detail. However, the above description is, in all aspects, for exemplary purposes and the present invention is not limited by the description. Numerous modifications not given as examples are understood to be conceivable without departing from the scope of the present invention.

DESCRIPTION OF REFERENCE NUMERALS

1 Wire with terminal
11 First crimped portion
12 Second crimped portion
13 First deformed portion
14 Second deformed portion
2 Terminal
21 Terminal connection portion
22 Core wire crimping portion
23 Sheath crimping portion
24 First combination portion
25 Second combination portion
3 Wire
31 Core wire
311 Exposed core wire
4 Sheath
5 Terminal crimping device
6 Bottom mold
7 Top mold
71 First top mold
72 Second top mold
73 Third top mold

The invention claimed is:

1. A method of manufacturing a wire with terminal comprising a wire and a terminal attached to an end portion of the wire comprises:

a) crimping a core wire crimping portion of the terminal onto an exposed core wire extending from an insulating sheathing member at the end portion of the wire;

b) crimping a sheath crimping portion of the terminal onto the insulating sheathing member; and c) designating at least one of a first combination portion, which links a terminal connection portion of the terminal and the core wire crimping portion and comprises a bottom and upright tabs standing upright from each of two ends of the first combination portion bottom, and a second combination portion, which links the core wire crimping portion and the sheath crimping portion and comprises a bottom and upright tabs standing upright from each of two ends of the second combination portion bottom, as a target combination portion and deforming the upright tabs of the target combination portion into an arc shape bulging outward such that an entire cross-section of the target combination portion, taken perpendicular to a longitudinal direction of the core wire, is defined by a continuous curve.

2. The method of manufacturing the wire with terminal according to claim 1, wherein the core wire crimping portion and the first combination portion are pinched between a first top mold and a first bottom mold to crimp the core wire crimping portion onto the exposed core wire and to deform the upright tabs of the first combination portion into an arc shape bulging outward.

3. The method of manufacturing the wire with terminal according to claim 1, wherein the sheath crimping portion is pinched between a second top mold and a second bottom mold to crimp the sheath crimping portion onto the insulating sheathing member, and the second combination portion is pinched between the second bottom mold and a third top mold distinct from the second top mold to deform the upright tabs of the second combination portion into an arc shape bulging outward.

4. A wire with terminal comprising:

a wire;

a terminal attached to an end portion of the wire;

a first crimped portion where a core wire crimping portion of the terminal is crimped onto an exposed core wire extending from an insulating sheathing member at the end portion of the wire;

a second crimped portion where a sheath crimping portion of the terminal is crimped onto the insulating sheathing member; and a deformed portion where at least one of a first combination portion, which links a terminal connection portion of the terminal and the core wire crimping portion and comprises a bottom and upright tabs standing upright from each of two ends of the bottom, and a second combination portion, which links the core wire crimping portion and the sheath crimping portion and comprises a bottom and upright tabs standing upright from each of two ends of the bottom, is designated as a target combination portion and the upright tabs of the target combination portion are deformed into an arc shape bulging outward such that an entire cross-section of the target combination portion, taken perpendicular to a longitudinal direction of the core wire, is defined by a continuous curve.

5. The method according to claim 1, wherein a diameter of the first combination part is smaller than diameters of the core wire crimping portion and the sheath crimping portion.

6. The wire terminal according to claim 4, wherein a diameter of the first combination part is smaller than diameters of the core wire crimping portion and the sheath crimping portion.

* * * * *